US009105203B2

(12) United States Patent
Carlson et al.

(10) Patent No.: US 9,105,203 B2
(45) Date of Patent: Aug. 11, 2015

(54) METHODS AND SYSTEMS FOR IDENTIFYING PRODUCT

(75) Inventors: Brian Philip Carlson, Lakeville, MN (US); Ryan A. Chernik, St. Paul, MN (US); John Thomas Pelkey, St. Paul, MN (US); Matthew Darold Lausted, Hudson, WI (US); Anthony Lee Kramer, Woodbury, MN (US)

(73) Assignee: ECOLAB USA INC., St. Paul, MN (US)

( * ) Notice: Subject to any disclaimer, the term of this patent is extended or adjusted under 35 U.S.C. 154(b) by 88 days.

(21) Appl. No.: 13/610,960

(22) Filed: Sep. 12, 2012

(65) Prior Publication Data

US 2013/0062364 A1 Mar. 14, 2013

Related U.S. Application Data

(60) Provisional application No. 61/534,433, filed on Sep. 14, 2011.

(51) Int. Cl.

| | |
|---|---|
| ***B67D 7/06*** | (2010.01) |
| ***G09F 7/00*** | (2006.01) |
| ***G09F 23/00*** | (2006.01) |

(52) U.S. Cl.

CPC ..... *G09F 7/00* (2013.01); *G09F 23/0058* (2013.01); *Y10T 29/49826* (2015.01)

(58) Field of Classification Search

CPC . B01L 2300/02; B01L 2300/024; G09F 3/20; B65D 5/4229; B65D 75/54

USPC ..... 222/181.1–182, 23; 235/439; 40/649; 206/459.5

See application file for complete search history.

(56) References Cited

U.S. PATENT DOCUMENTS

| | | | | |
|---|---|---|---|---|
| 5,992,073 | A * | 11/1999 | Wolpa | 40/651 |
| 6,347,471 | B1 * | 2/2002 | Mirza | 40/661 |
| 7,028,861 | B2 * | 4/2006 | Sayers et al. | 222/1 |
| 8,212,949 | B2 * | 7/2012 | Pelfrey et al. | 349/16 |
| 2003/0011476 | A1 | 1/2003 | Godfrey | |
| 2008/0215443 | A1 * | 9/2008 | Dooley et al. | 705/14 |
| 2009/0219131 | A1 * | 9/2009 | Barnett et al. | 340/5.2 |
| 2011/0046911 | A1 | 2/2011 | Studer | |
| 2011/0127290 | A1 * | 6/2011 | Law et al. | 222/1 |

FOREIGN PATENT DOCUMENTS

WO WO 2004/066782 A1 8/2004

OTHER PUBLICATIONS

Ecolab USA Inc. et al., PCT/US2012/054819, "Notification of Transmittal of the International Search Report and The Written Opinion of The International Searching Authority, or The Declaration" mailed Feb. 26, 2013.

* cited by examiner

*Primary Examiner* — Kevin P Shaver
*Assistant Examiner* — Robert Nichols, II
(74) *Attorney, Agent, or Firm* — McKee, Voorhees & Sease, PLC

(57) ABSTRACT

A method and system for identifying product is disclosed. A product identifier having product identifying information for one of a plurality of consumable products is provided. The product identifier is selected for a consumable product. The product identifier is displayed at or near a location on a dispensing system, or where access to the consumable product is provided. The system uses a product identifier having product and/or brand information for one or more consumable products. A window is provided in a body of a dispenser or dispensing system for viewing the product identifier associated with the consumable product therein.

5 Claims, 9 Drawing Sheets

METHODS AND SYSTEMS FOR IDENTIFYING PRODUCT

CROSS-REFERENCE TO RELATED APPLICATIONS

This application claims priority under 35 U.S.C. §119 to provisional application Ser. No. 61/534,433 filed Sep. 14, 2011, herein incorporated by reference in its entirety.

FIELD OF THE INVENTION

This invention relates generally to methods and systems for identifying product, and more particularly to methods and systems for labeling and identifying a consumable product that is replenished or changed out from time to time.

BACKGROUND OF THE INVENTION

Product dispensers dispense a consumable product and as such, from time to time, the consumable portion needs replenished or replaced with a different type of consumable product. During this process, the dispenser or nondisposable portion of the system receives the new or different consumable product. For example, the systems may receive and house a bladder-like member containing a prefilled amount of product. These systems benefit from the ability to quickly label and/or identify what consumable product is being dispensed, such that the systems can be replenished quickly without much downtime, or so that the product can be quickly replaced with a different product based on factors such as consumer demand.

Quick and cost efficient ways to label and identify the consumable product provide numerous benefits for operating, monitoring, servicing, and providing user support to a dispensing process. For example, product identifiers associated with a consumable product quickly communicate to an end user what consumable product will be dispensed, what consumable product to use to replenish or refresh the dispenser, what concentrate or brand of product should be used, and what type of consumable product should be communicated to the dispensing unit.

Therefore, there is a need in the art for a cheap, professional, and flexible product identification method and system that can be used with a variety of refillable dispensing units that will quickly, efficiently, and consistently provide product and brand identification for the dispensing unit.

SUMMARY OF THE INVENTION

It is therefore a primary object, feature, and/or advantage of the present invention to provide a method and system for identifying a product.

It is another object, feature, and/or advantage of the present invention to provide cost efficient ways to communicate information to the end user about the consumable to aid in quickly identifying what consumable product is being dispensed and what consumable product should be used to replenish or replace the product being dispensed.

It is yet another object, feature, and/or advantage of the present invention to provide a cost efficient way to quickly identify what type of consumable product is being dispensed by providing means for product identification configured into a non-disposable or non-consumable portion of a dispenser, or at a product access or dispensing point.

It is still another object, feature, and/or advantage of the present invention to provide a method and system for identifying a product that can be used with a multitude of dispensers.

It is a further object, feature, and/or advantage of the present invention to provide a method and system to identify a product, a brand of the product, and a concentration of ingredients of the product.

It is still a further object, feature, and/or advantage of the present invention to provide a method and system for identifying a product and/or a brand that can be quickly changed.

It is yet a further object, feature, and/or advantage of the present invention to provide a method and system for identifying a product by placing the identification on a portion of the product packaging.

These and/or other objects, features, and advantages of the present invention will be apparent to those skilled in the art. The present invention is not to be limited to or by these objects, features and advantages. No single embodiment need provide each and every object, feature, or advantage.

According to an aspect of the present invention, a method for identifying product is provided. The method includes providing a plurality of product identifiers each having product identifying information for at least one of a plurality of consumable products, selecting the product identifier for a consumable product, and displaying the product identifier at or near a location on a dispensing system where access to the consumable product is provided.

According to another aspect of the present invention, a system for product identification is provided. The system includes a product identifier having product identifying information for a consumable product, a dispensing system having a body for at least partially housing the consumable product, and a window in the body for viewing the product identifier associated with the consumable product.

DETAILED DESCRIPTION OF THE PREFERRED EMBODIMENTS

Figure 1:
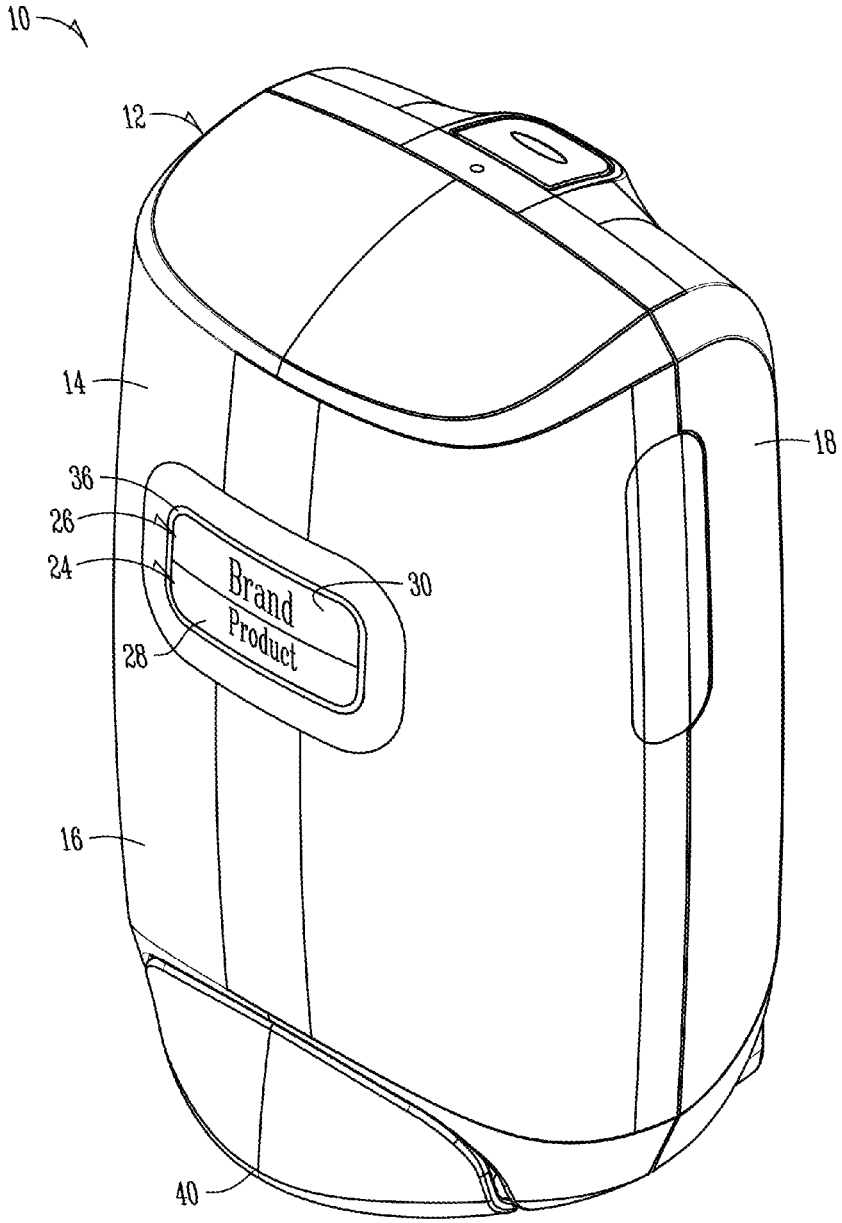
FIG. 1 is a perspective view of a dispensing system having the product identification according to the present invention.

Labeling and other identifying information associated with a product, such as a consumable product, alerts the end user of several things. For example, product labeling identifies the contents or the consumables in the product container, identifies the source of the manufacturer of the product or consumables, and any other information pertinent to the end user to make decisions about how the product or consumable is used.

The information may include chemical information such as ingredients and amounts thereof. Product information included on the labeling or printed on product packaging also informs the end user of what type of consumable or product should be selected to replace the depleted product. For examples, the dispensers that dispense products, such as a consumable product, exhaust the product over time and will require replenishing. One dispenser may dispense several types of consumables or products. For example, a hand dispenser may dispense hand soap, lotion, antibacterial soap, or other types of consumable products. Providing the end user or person in charge of replacing the consumable with visual queue, such as product identifying information, either on the product packaging or the dispensing system itself is essential to avoid confusion and misuse of a product, consumable, or the dispensing system.

Awareness of the type of product or consumable by inspection of product information on product packaging, a label, or the dispenser provides the end user with information that is beneficial when changing, replacing, reordering, servicing, troubleshooting, or addressing any other questions related to the type of product or consumable being used or dispensed. Providing awareness to an end user of the product identifying information for a consumable can be accomplished by positioning one or more product identifiers at various locations. These locations include at least at the dispensing system, such as at a viewing window or at a location on or around the dispensing system. Other locations include a point of axis for the consumable products, such as where the consumable is not in close proximity to the point of dispensing, and/or the dispensing system. As product packaging and labeling represents a significant cost of a product or consumable, it can be appreciated that the most efficient and effective use of such labeling could result in significant cost savings to a manufacturer or producer of the product or consumable. Therefore, management of the user of product labeling and printing, including the information provided with a consumable or product, can yield a tremendous cost savings, and at the same time provide the end user with a product identification system or method that permits tracking and visual inspection at all times the product or consumable is being used. Accordingly, what follows is a description of embodiments for achieving the above-identified objectives. The Figures illustrate but a few aspects or methods and systems for identifying a product, such as a consumable product.

FIG. 1 is a perspective view of a dispensing system 10 having a product identifier 24 containing product identification 26 according to the present invention. As shown in FIG. 1, the dispensing system 10 includes a dispenser 12 having a dispenser body 14. The dispenser 12 is shown to be a hand dispenser, such as the kind used to dispense hand soap, lotion, or the like. However, it should be appreciated that the present invention is not limited to hand dispensers, and includes any type of dispensing or consumable product dispensing device or system. The hand dispenser 12 of FIG. 1 is shown merely for exemplary purposes. The dispenser body 14 comprises a first portion 16 and a second portion 18. The second portion 18 of the dispenser body 14 is generally affixed to a wall or other surface. The second portion 18 may be hung, bolted, or otherwise affixed to the wall and is stationary in relation to said surface. The first portion 16 of the dispenser body 14 is moveable in relation to the second portion 18. The movability of the first portion 16 allows an operator or user to open the dispenser 12 to fill, replace, or otherwise have access to an interior of the dispenser 12. As shown in the Figures, the first portion 16 is hingeably connected to the second portion 18 about a hinge 20. Therefore, the first portion 16 is able to rotate about said hinge to provide access to the interior of the dispenser 12.

Also shown in FIG. 1 is a product identifier 24. The product identifier 24 is shown as part of the first portion 16 of the dispenser body 14. The first and second portions 16, 18 of the dispenser body 14 may generally comprise a plastic material, which may be molded or otherwise formed to form the components. Therefore, the location for the product identifier 24 may be formed, such as molded, as part of the dispenser body 14. The product identifier 24 includes product identifying information 26 that is shown through a window 36 in the first portion 16 of the dispenser body 14. The product identifying information 26 may include various forms of information. For example, FIG. 1 shows the product identifying information 26 to include product information 28 and brand information 30. The band information 30 generally comprises the manufacturer or originator of the consumable product 22 that is stored and dispensed from the dispenser 12. The product information 28 generally comprises product information, such as the concentration, solution, or other identification information. For example, when the product is hand soap, the product identification 28 may simply state "hand soap". Other information could be provided by the product identifier 24. For example, safety information, quantity size, year or date of manufacture, pH levels, SPF level, or the like, could also be included as part of the product information.

Furthermore, as shown in the Figures, the product identifier 24 is shown through a window 36 formed in the first portion 16 of the dispenser body 14. The window 36 may include a clear cover, such as a clear polycarbonate cover, for covering the viewing window and the product identifier. The clear cover is preferably a material having high optical quality so as to provide aesthetic appeal to the product identifier and dispenser. For example, depending upon the optical clarity of the cover over the viewing window, the graphics and text on the product identifier 24 may appear more glossy and professional without the additional printing expense that would be required to make the product identifier 24 appear glossy and professional when used without the clear cover or window 36. The cover 36 also provides a barrier to protect the graphics and print on the product identifier 24 from being damaged or from fading over time. The cover also provides a moisture barrier to prevent the product identifier 24 from being exposed to moisture or unintended contact with moisture or product in the ambient environment.

Figure 2:
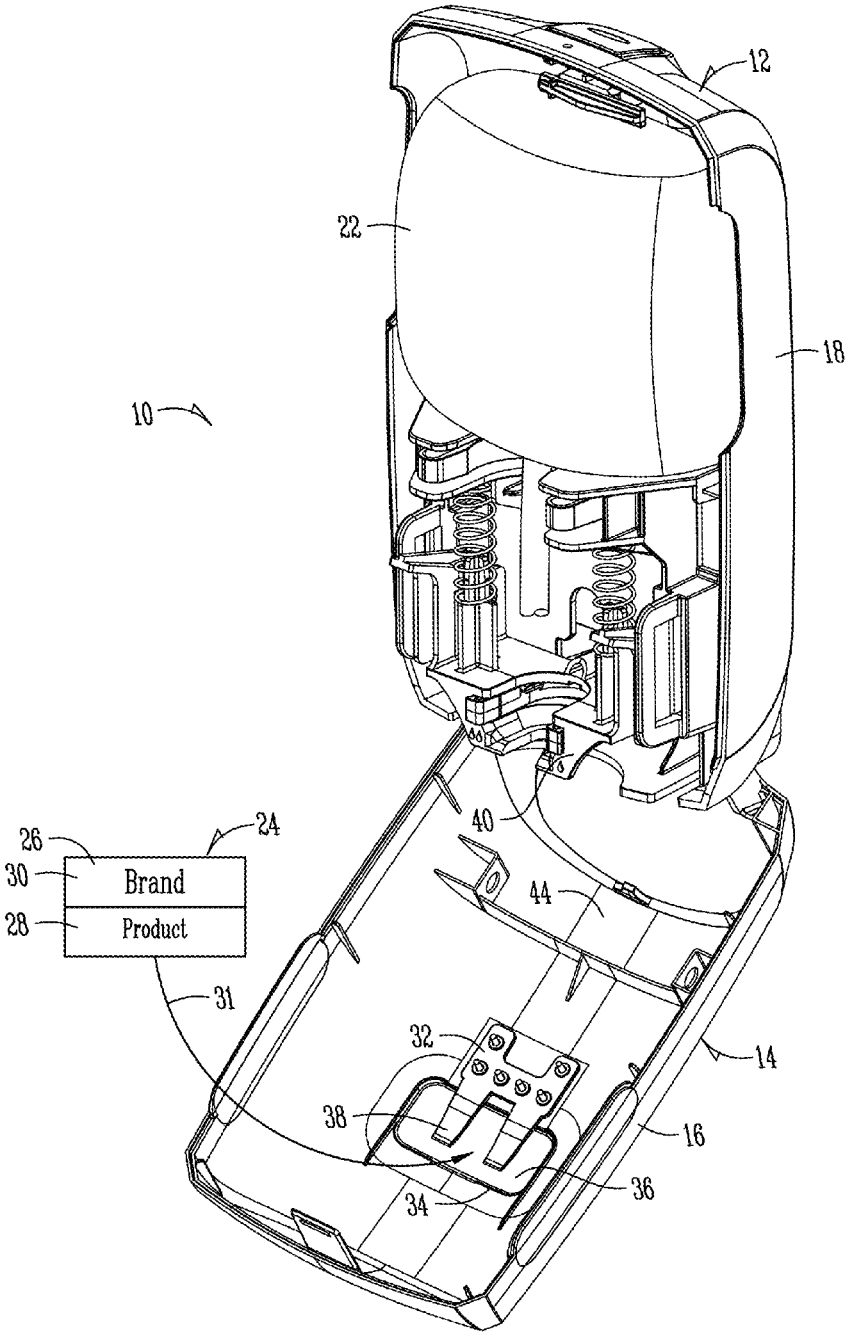
FIG. 2 is a perspective view of the dispensing system of FIG. 1 in an open position.

FIG. 2 is a perspective view of the dispensing system 10 of FIG. 1 in a generally open position. As discussed above, the first portion 16 and the second portion 18 of the dispenser body 14 are connected to one another about a hinge 20. Therefore, the first portion 16 is able to move relative the second portion. The first portion 16 may be opened to fill or refill the consumable product 22, or the first portion 16 may be moved to provide access to the interior of the dispenser 12 to repair a portion or mechanism of the dispenser 12. The dispenser may be closed by rotating the first portion 16 in a generally upward manner and snapping or otherwise locking the portions 16, 18 to one another. However, it should be appreciated that other means and mechanisms for providing access to the interior of the dispenser 12 are considered to be part of the present invention. For example, the hinge may be on the sides such that the portion rotates about a generally vertical axis to mate with one another. Alternatively, only parts or portions of the first portion 16 may be moveable in relation to the second portion 18. The present invention is not to be limited to the method and/or means of providing access to the interior of the dispenser 12.

As shown in FIG. 2, a consumable product 22 is housed between the first and second portions 16, 18 of the dispenser body 14. The consumable product 22 is generally housed in a deformable bag or other container such that all of the contents may be removed or dispensed from the bag upon continued use of the dispenser 12. Once all of the contents of the consumable product 22 have been depleted, the dispenser can be opened and consumable product 22, including its container, can be replaced quickly and easily such that additional product may be dispensed. In addition, the dispenser 12 and consumable product 22 are such that if there is a desire to change the product being dispensed from the dispenser 12, the dispenser can be opened and the consumable product 22 can be quickly and easily replaced with the new or desired product.

Upon a first loading of consumable product 22 into the dispenser 12, as well as during any change of product, or update of current product, the product identifier 24 may be changed or updated. The product identifier 24, as discussed above, includes product identifying information 26, such as product information 28 and brand information 30. The product identifier 24 is generally a badge-type device that can be made of thin plastic that is printed thereon. Making the product identifier 24 out of a plastic allows the product identifier 24 to be water resistant and more resilient to ambient conditions. However, it should be appreciated that the product identifier 24 may be made of other materials such as tag board, cardboard, or other types of paper, plastic, metal, or the like. Furthermore, the badges may also include tabs (not shown) or other appendages that aid in the grasping, loading, and removing of the badges. The tabs would be small in size and would not be viewable through the window of the system.

Figure 3:
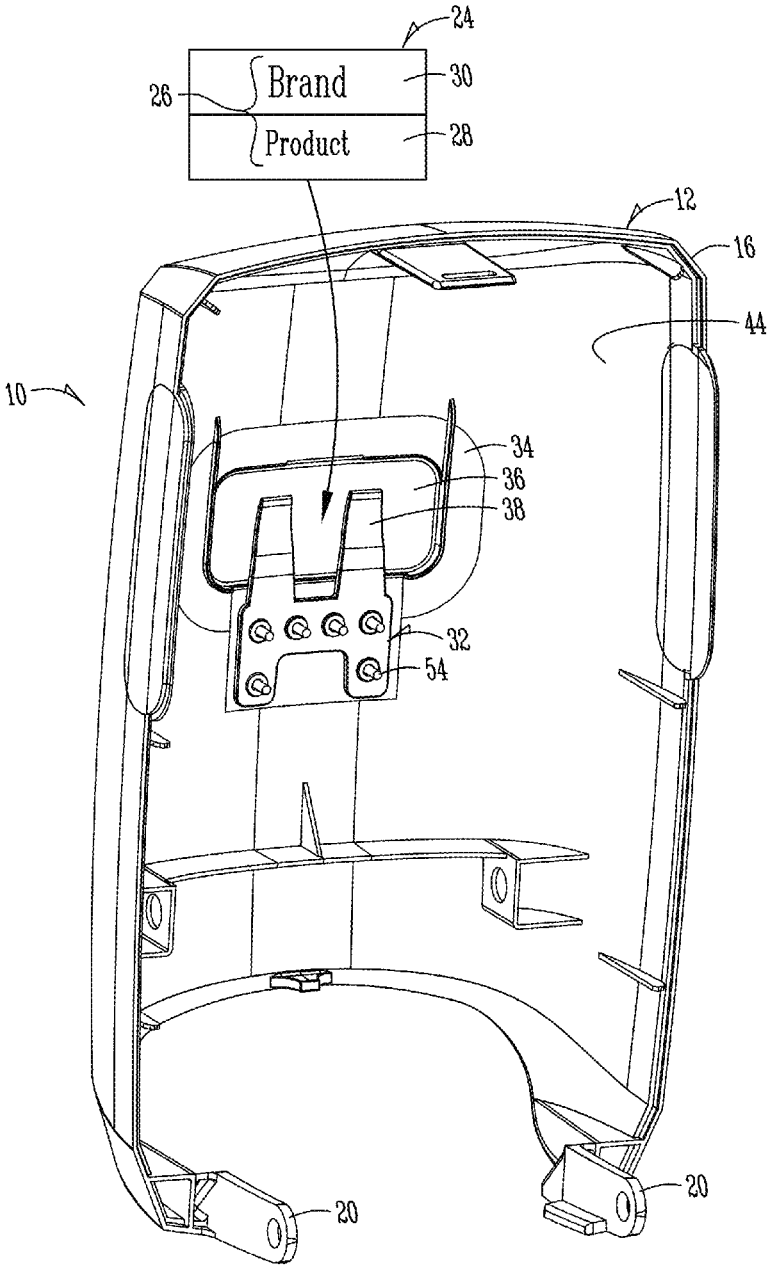
FIG. 3 is an internal and rear view of a first body portion of the dispensing system of FIG. 1 showing the product identification of the present invention.

As shown generally in FIGS. 2 and 3, the product identifier is stored adjacent the window 36 on the interior 44 of the first portion 16 of the dispenser 12. As noted above, the first portion 16 includes a general recessed area 34, which may include an aperture through the first portion 16. The aperture may be covered by or filled with a window 36 or other cover, as noted above. Thus, the product identifier 24 is placed in the recess 34 and at window 36 so that a user can view the information stored on the product identifier 24 through the window 36. To further hold the product identifier 24 in place, a holder 32 is positioned on the interior or backside 44 of the first portion 16 and window 36. The holder 32 comprises one or more retaining arms 38 extending from a base that is affixed to the housing. The retaining arms extend from base of the holder 32 and provide a retention area between the arms 38 and the window 36. Thus, the product identifier 24 can be slid between the retention arms 38 and the window 36 to hold the product identifier 24 in place in position for viewing.

As shown by the arrows 31 in FIGS. 2 and 3, the product identifier 24 is generally slid over a top portion of the retention arms 38 and between the retention arms 38 and the window 36. While the retention arms 38 exert a force generally directed towards the window, the force may be easily overcome to slide the product identifier 24 between the arms and window. However, the retention arms 38 include some elasticity to re-exert tension to press the badge in place. Furthermore, as shown in the Figures, the holder 32 may be attached or otherwise affixed to the first portion 16 of the dispenser body 14 by screws 54. Other methods and means of attaching the holder 32 to the dispenser body 14 are also contemplated to be part of the invention. For example, the holder 32 may be adhered to the dispenser body 14 via adhesive, screws, snaps, Velcro®, or the like. It is also contemplated that the holder be molded or otherwise formed as part of the dispenser body 14 such that it is integrally one piece with the dispenser body 14. Therefore, the holder 32 may comprise a material similar to the dispenser body, such as plastic or the like.

Figure 4:
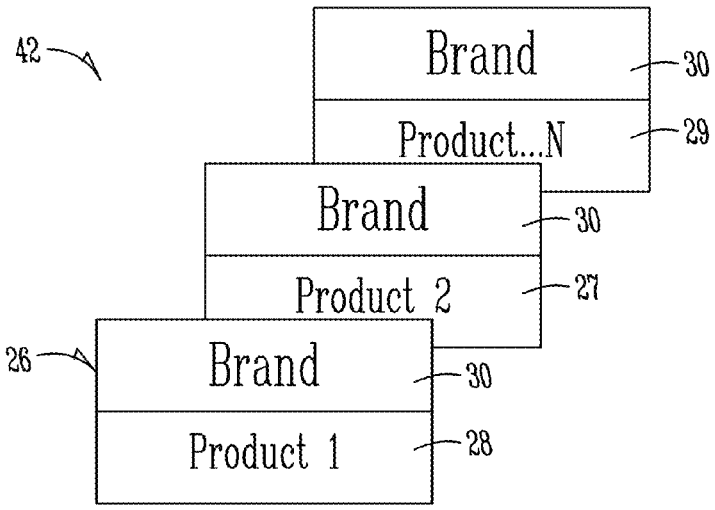
FIG. 4 is a perspective view of a plurality of product identifiers that can be used with the dispensing systems of the present invention.

FIG. 4 is a perspective view of a plurality 42 of product identifiers that can be used with the dispensing system 10 of the present invention. As noted above, the dispenser 10, as well as other dispensers contemplated by the present invention, can house and dispense a variety of or multiple products. Therefore, when manufacturing and shipping a dispenser 12, the system 10 may be sent with a plurality of product identifiers 42. The plurality of product identifiers 42 may be any number of identifiers that include product information pertinent to any and all numbers of different products that can be used with the dispenser. For example, FIG. 4 shows three product identifiers. The three product identifiers all include product identifying information 26. The front most product identifier includes brand information 30, as well as product information 28 for a first product, hereinafter noted as "product 1". The middle product identifier includes brand information 30, which in this case is the same brand information as shown in the first or front most product identifier. However, the second product identifier includes different product information 27, which hereinafter may be referred to as "product 2". This may be continued for as many different types of product that can be used with a dispenser up until product information for "product N" 29, as is shown in the third or rear product identifier. Thus, the present invention contemplates any number of product identifiers being included with the present invention. As noted, the product identifiers all include different product information, and at times, different brand information.

Thus, an example of the use of the present invention is as follows. An operator or user determines a need to either fill, replace, or refill a dispenser, such as the dispenser 12 shown in FIGS. 1-3. The operator determines the consumable product 22 to install in the dispenser 12 based on need, desire, or shipping orders. Once the appropriate product has been inserted in the dispenser 12, the operator and/or user then looks through the plurality of product identifiers 42 to determine the appropriate product identifier 24 that includes product identifying information 26 that matches the consumable product 22 that has been added to the dispenser 12. Then, the operator loads the appropriate product identifier 24 into the holder 32 adjacent the window 36 of the dispenser 12, and closes the first portion 16 of the dispenser body 14. It is noted that the loading occurs on the inside of the housing. Upon closing, the window 36 will display the product and brand information 28, 30 for the consumable product 22 that will be dispensed by the dispenser 12. Put another way, the information on the badge will be viewable through the window 36 as the consumer or operator approaches the system 10. The remaining or unused product identifiers can also be stored in the holder 32 behind the selected product identifier 24 to store the additional identifiers for a potential later use.

For example, once the consumable product 22 has been depleted, it may be determined that a different product be added to the dispenser 12. At this time, the new product can be installed into the dispenser, and the different product identifier 24 having information for the new product can be rearranged to be in the front of the group or plurality of product identifiers such that the new product identifier is positioned adjacent the window 36 of the dispenser 12. Thus, when a user approaches the dispenser, the user will note that the product within the dispenser has changed, and will be aware of what the new product in the dispenser is, thus eliminating any potential confusion for the consumer. The ability to quickly and easily change the product identifier 24 in the dispenser allows the consumer to easily know of any updated changes to the dispenser, while also providing information related to the manufacturer and contents, concentrate, or other information related to the product in the dispenser. Furthermore, as the product identifier 24 is field swappable (not permanent), the system can be updated or changed quickly and easily at any time.

Figure 5:
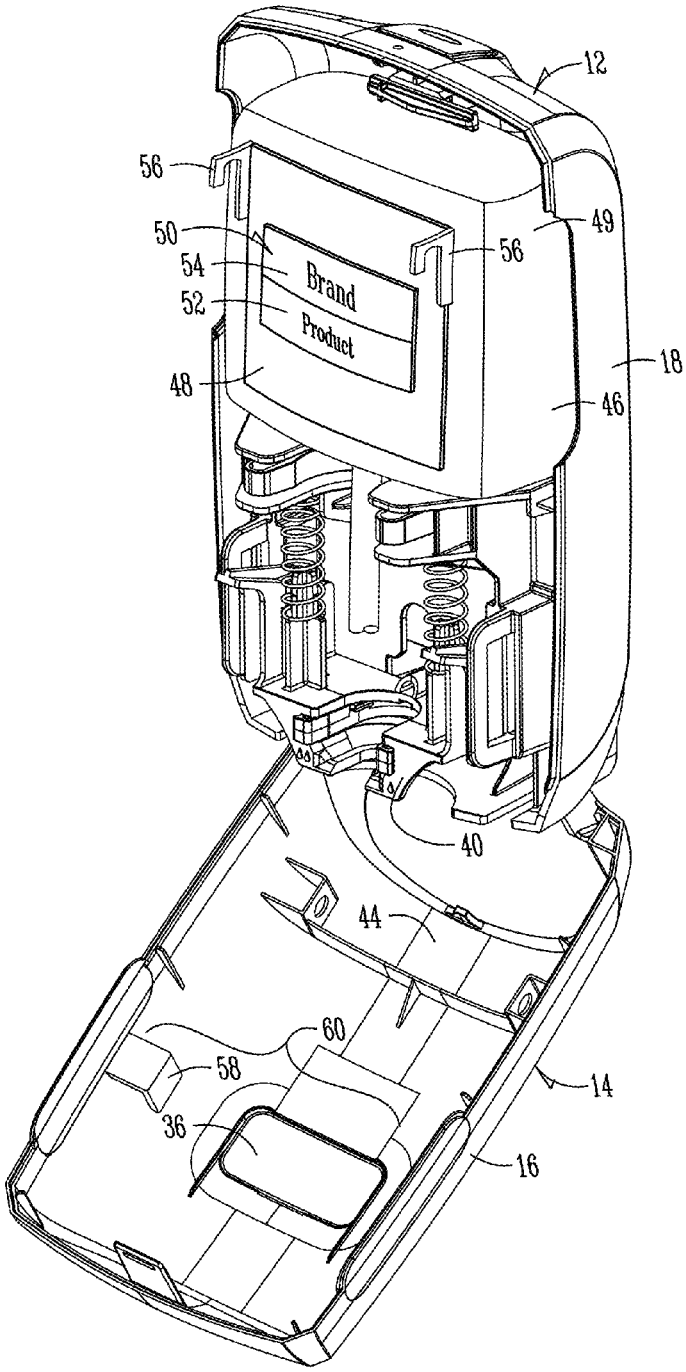
FIG. 5 is a view similar to FIG. 2 showing another embodiment of a dispensing system of the present invention relating to product identification of a dispensing system.
Figure 6:
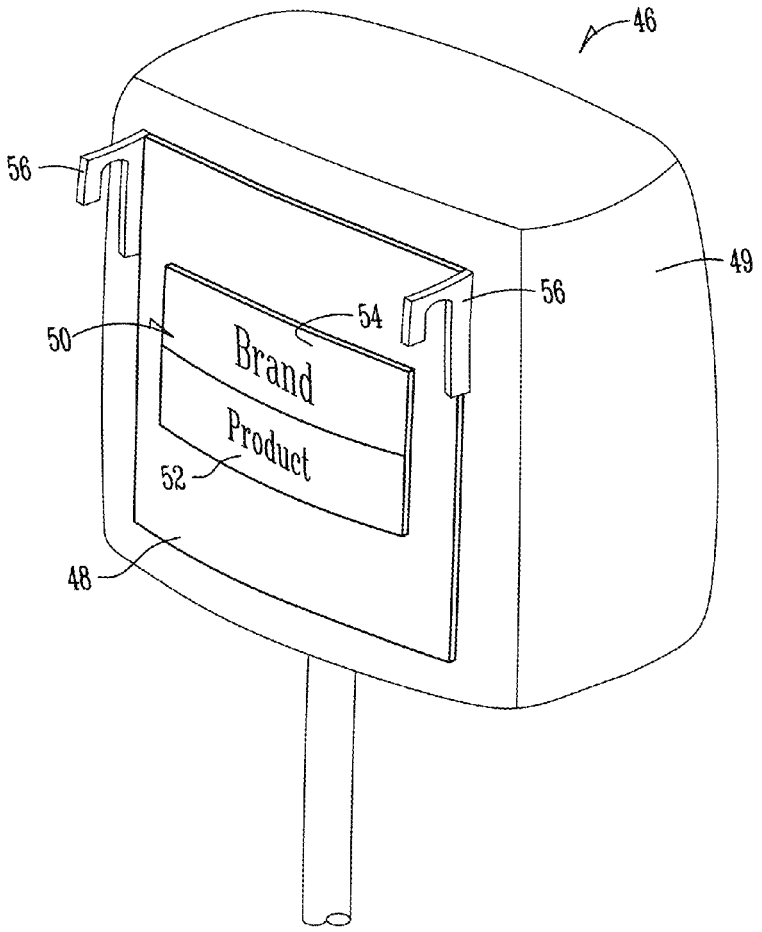
FIG. 6 is a perspective view of a consumable product for use with the dispensing system of FIG. 5 according to the present invention.

FIGS. 5 and 6 illustrate additional aspects of the present invention. In FIGS. 5 and 6, the product identification information 50 is formed as part of the consumable product package 46. Generally, product packaging changes shape or deform as the consumable is dispensed from the dispenser 12. However, in FIGS. 5 and 6, the product identifying information 50 is printed onto or secured to a label of the packaging of the consumable product 46. The product identification 50 is secured to a portion of the product packaging 46 that includes a thicker wall portion 48 providing some rigidity at the point of securement to resist deformation along with the rest of the packaging. The rigid portion 48 maintains an aesthetic look and feel during the dispensing of the product from the dispenser 12. For example, the consumable product container 46 may be blow molded so that a portion of the container has a wall thickness greater than the rest of the container to provide a section of rigidity where the product identifying information 50 is printed on or secured to the package using a label or other placard-type product identifier. When the container shrinks or changes shape due to dispensing, the more rigid wall section 48 of the consumable product 46 package maintains its shape, thereby preserving the aesthetics of the product identifying information 50 on the label/placard.

Furthermore, as shown in FIGS. 5 and 6, the use of the product identifying information 50 on the consumable product packaging 46 eliminates the need for a holder, as is shown in previous figures. However, to maintain the product identification 50 in place, the rigid section 48 may include wings/hooks 56 or other members that can be attached to guides, tracks, railings, hooks, or other securing means 58 on the interior 44 of the first portion 16 of the dispenser body 14. The securing of the packaging 46 to the interior 44 of the first section 16 also aligns the product identification 50 with the window 36 in the first section 16. Therefore, the guides and window may form a viewing assembly 60 to align the product identification 50 with the first section to display the product identification 50 (product information 52 and brand information 54) to a consumer, user, or operator.

Similar to previous embodiments, the product identification 50 may include such information such as product information 52 and brand information 54. The brand information 54 generally includes information relating to the manufacturer of the consumable product stored in the package 46. The product information 52 displays information related to the product, such as type of product, concentrate of product, amount of product, and the like. However, it should be appreciated that other types of information, as well as more or less information, may be included as part of the product identification 50, and the invention is not to be limited by the information shown.

While FIG. 5 shows the product packaging 46 positioned in the second portion 18 of the dispenser body 14, the use of the invention is as follows. Once the appropriate product has been determined, the operator selects the package 46 containing the product. The product package 46, including the product identification 50 on the rigid portion 48, is attached to the interior 44 of the first section 16 of the dispenser body 14. As shown in FIGS. 5 and 6, the rigid portion may include wings or hooks 56 that can be slid into guides or tracks 58 formed in the interior 44 of the first section 16. The guides or tracks 58 can include stopping sections such that the product identification 50 of the package 46 is aligned with the window 36 of the dispenser 12. Therefore, even when the product package 46 deforms due to the depletion of the product within the package, the rigid portion 48 including the product identification 50 will always be aligned with the window 36 in the first section 16 such that a user, consumer, or operator, may determine the type of product stored therein. Once the consumable product has been fully depleted, the window will allow an operator to quickly and easily determine the appropriate product to replace in the dispenser 12.

Figure 7:
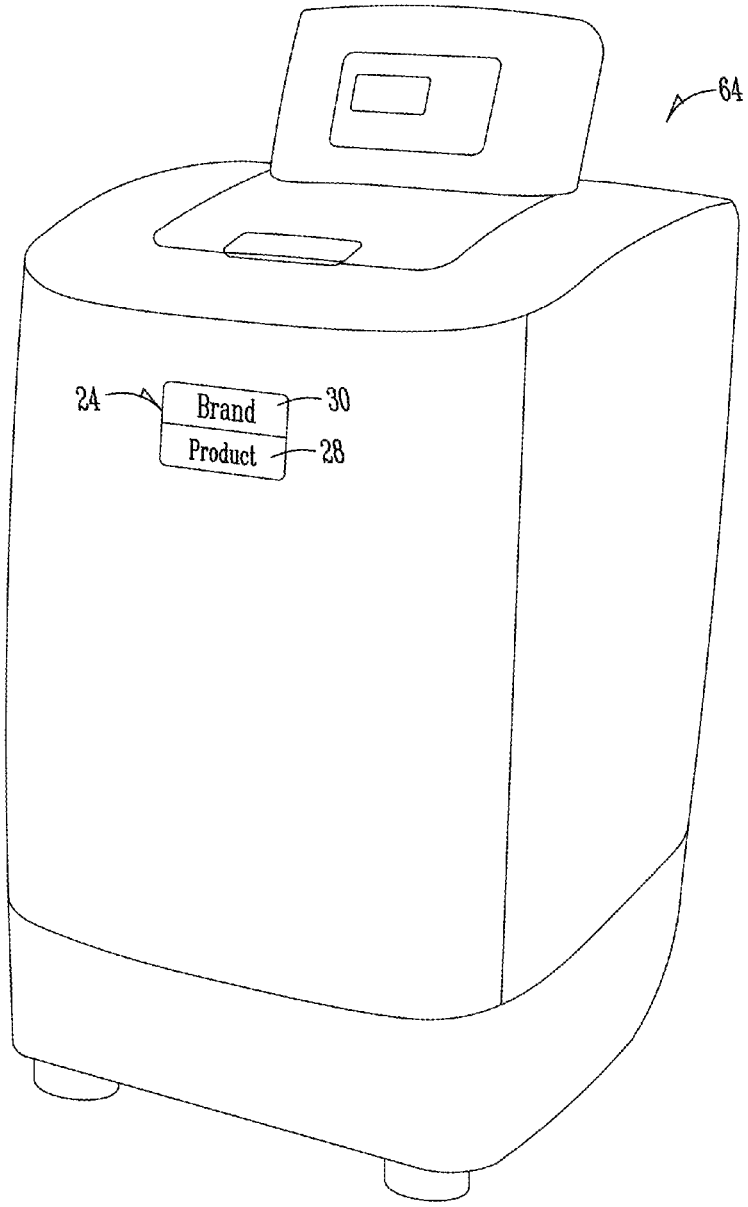
FIG. 7 is a perspective view of another embodiment of a dispensing system according to the present invention.
Figure 8:
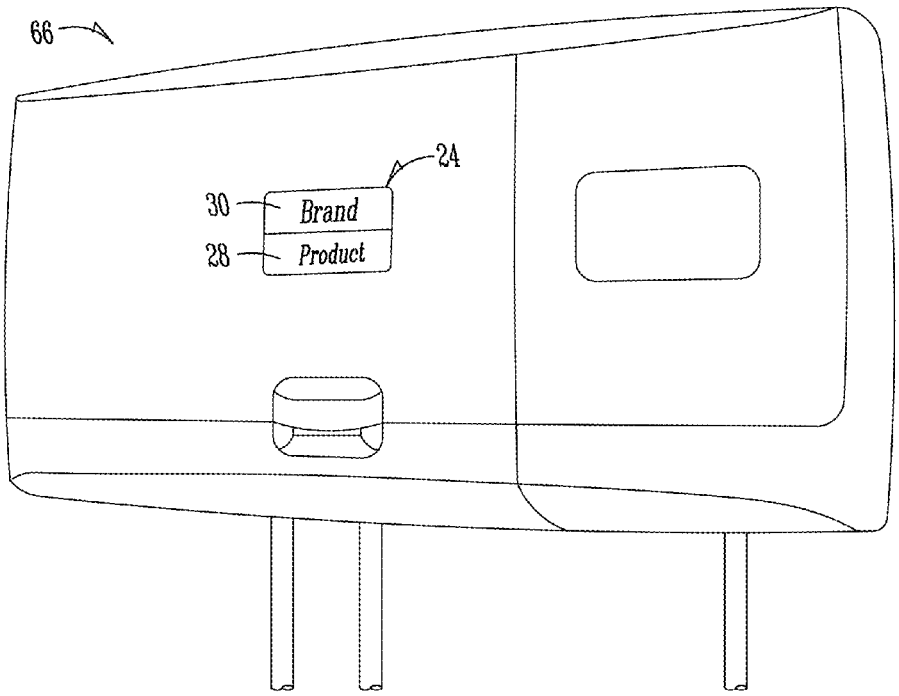
FIG. 8 is a perspective view of another embodiment of a dispensing system according to the present invention.
Figure 9:
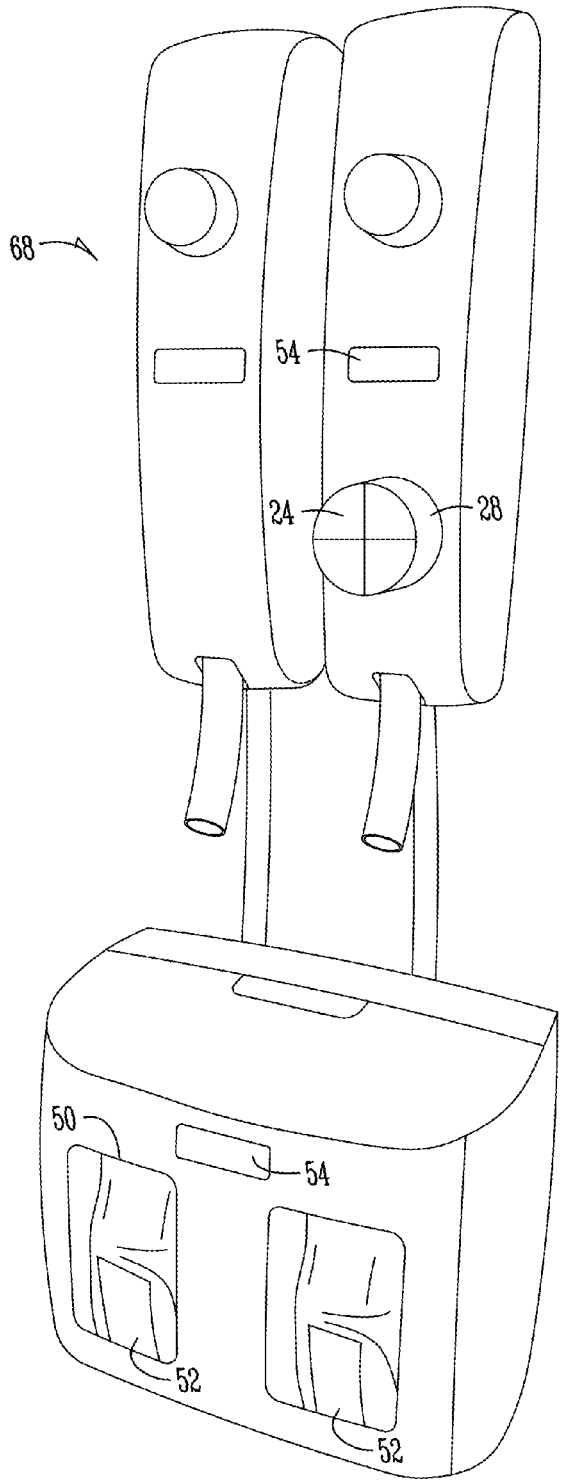
FIG. 9 is a perspective view of another embodiment of a dispensing system according to the present invention.

FIGS. 7-9 are additional embodiments of dispensers that can be used with the product identification system of the present invention. As shown in FIG. 7, the dispensing system 64 can include a product identifier 24 on the front of the housing of the dispensing system 64, and can include both the product information 28 and brand information 30 for a consumable product stored in the dispensing system 64. Furthermore, it should be appreciated that the brand 30 may be permanently affixed to the housing of the dispensing system 64, while the product information 28 be updated and changed as the product stored therein is updated and/or changed. The housing can be opened to provide access to change the consumable product and the product identification on the housing as needed.

FIG. 8 is another embodiment of a dispensing system 66 including the product identifier 24 according to the present invention. Again, the product identifier 24 includes both product identifying information 28 as well as brand information 30. A portion of the dispensing system 66 can be opened to allow the product identifier 24 to be changed, updated, or replaced.

FIG. 9 is yet another embodiment of a dispensing system 68 including product identification according to the present invention. As shown in FIG. 9, the dispensing system 68 includes a storage housing and a dispensing housing. The storing housing, which is shown at the bottom of the figure, includes one or more consumable products. Therefore, the products may include the rigid section having product information placed thereon, as was shown and discussed in relation to FIGS. 5 and 6, to designate the type of product and brand stored in the dispensing system 68. Furthermore, the upper section includes an identification system section 24. The identification section may be rotated or otherwise adjusted to adjust the amount, concentration, or type of product being dispensed from the storage compartment. Therefore, the dispensing system 68 may include a plurality of product information segments at the dispenser. Once the appropriate product is selected, for instance by rotating a nozzle, the user will know what type and amount of product will be dispensed by the alignment of the product identifier. However, a next user may adjust the dispenser to dispense a different product. To do so, the dispenser may include a nozzle that is rotated to select a different product, which will then be dispensed according to the user's selection.

Additional types of product identification are intended to be part of the present application. For example, instead of additional tags or badges containing the brand and product information, the product identifier may include a strip or circular disc including multiple brands and/or product information. To adjust the information shown through the window or other viewing device, the strip or disc may be iterated up and down, side to side, or rotationally to adjust the displayed information. Furthermore, the product identifiers may be formed together with weak portions such that the product identifiers including different product information can be broken off from one another and then fit into the holder or other display of the dispensing system. Furthermore, the product identifiers may include hinges, or snaps, while connected together to pop or snap a selected product and/or brand information brand identifier into a slot to display the selected identifier.

Using the additional types of product identification may also open the system to other changes. For example, the window and recess could be replaced with generic openings that are molded in the housing. A product identifier could then be snapped into the opening and actually extend through the housing to an exterior in front of the housing to designate the brand, product, and/or other information. Other methods of holding the product identifiers in place are also contemplated as part of the present invention.

The foregoing description has been presented for purposes of illustration and description, and is not intended to be an exhaustive list or to limit the invention to precise forms disclosed. It is contemplated that other alternative processes obvious to those skilled in the art are considered to be included in the invention. The description is merely examples of embodiments. For example, the shapes, sizes, types of information, amount of identification devices, or the like may also all be varied according to the specific need and desirability of the manufacturer, technician, or consumer. It is understood that any other modifications, substitutions, and/or additions may be made, which are within the intended spirit and scope of the invention. From the foregoing, it can be seen that the present invention accomplishes at least all of the stated objectives.

What is claimed is:

1. A system for product identification, comprising:

a plurality of product identifiers each having product information for a different consumable product;

a dispensing system having a body for at least partially housing one of the consumable products identified by a product identifier; and a holder in the body for holding and displaying the product identifier associated with the consumable product while also holding and storing the remainder of the plurality of product identifiers for the consumable products not being housed in the dispensing system body;

said holder being biased towards an interior of the body to actively hold the plurality of product identifiers in place adjacent a viewing portion in the body.

2. The system of claim 1 further comprising a window in the viewing portion of the body adjacent the holder for viewing the product identifier corresponding to the consumable product housed within the dispensing system.

3. The system of claim 2 wherein all of the product identifiers are positioned between the holder and the window with the holder biasing the product identifiers towards the window and interior of the body.

4. The system of claim 3 wherein the plurality of product identifiers comprise product information for a different consumable product including both a brand and product information related to the consumable product, wherein the window comprises a substantially transparent material.

5. The system of claim 1 wherein the holder comprises at least one arm member for holding the product identifier in place.

* * * * *